US011557188B2

(12) United States Patent
Antar et al.

(10) Patent No.: US 11,557,188 B2
(45) **Date of Patent: *Jan. 17, 2023**

(54) GUNSHOT DETECTION DEVICE, SYSTEM AND METHOD

(71) Applicant: Halo Smart Solutions, Inc., Bay Shore, NY (US)

(72) Inventors: David Antar, Babylon, NY (US); Paul Galburt, Punta Gorda, FL (US); Frank L. Jacovino, Northport, NY (US); David Rayna, Malverne, NY (US)

(73) Assignee: Halo Smart Solutions, Inc., Bay Shore, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/715,311

(22) Filed: Apr. 7, 2022

(65) Prior Publication Data

US 2022/0246008 A1 Aug. 4, 2022

Related U.S. Application Data

(63) Continuation of application No. 17/471,279, filed on Sep. 10, 2021, now Pat. No. 11,302,163.

(60) Provisional application No. 63/144,075, filed on Feb. 1, 2021.

(51) Int. Cl.
*G08B 17/08* (2006.01)
*G08B 29/18* (2006.01)

(52) U.S. Cl.
CPC ..... *G08B 17/08* (2013.01); *G08B 29/185* (2013.01)

(58) Field of Classification Search
CPC ..... G08B 17/00; G08B 13/1672; G01J 1/42; H04N 5/33; G01S 3/8006; G01S 5/18
See application file for complete search history.

(56) References Cited

U.S. PATENT DOCUMENTS

2007/0125951 A1* 6/2007 Snider ..... F41G 3/147 250/363.03
2014/0184806 A1* 7/2014 Tidhar ..... G01J 1/42 348/164
2014/0269199 A1* 9/2014 Weldon ..... G01S 5/18 367/124
2020/0211361 A1* 7/2020 McSchooler ..... G08B 21/02
2021/0049881 A1* 2/2021 Connell, II ..... H04W 56/0015

* cited by examiner

*Primary Examiner* — Mirza F Alam
(74) *Attorney, Agent, or Firm* — Williams Mullen; Thomas F. Bergert

(57) ABSTRACT

A system, device and method facilitate accurate detection of gunshot events through spectrum analysis of impulse signals and/or evaluating impulse signal exponential decay amplitude and time values. In various embodiments, the device and system employ an acoustic sensor, one or more high-pass and low-pass filters, a threshold detector, a differentiator, a decay waveform shape generator, one or more comparators and one or more timers to facilitate detection of gunshot events and/or components of gunshot events.

17 Claims, 5 Drawing Sheets

10
100
mic
2-Pole High Pass Filter
101
filtered mic signal
121
Threshold Detector
102
Absolute Value and Low Pass Filter
106
Differentiator
108
signal envelope
120
32
Extend Timer
103
Switch (normally on)
119
104
Decay Waveform Shape Gen
105
Absolute Value and Low Pass Filter
109
31
Window Comparator
107
Ratio Comparator
110
AND Function
111
115
Reset
113
Overall Event Timer
Abort
Validity Timer
112
116
118
Detection

GUNSHOT DETECTION DEVICE, SYSTEM AND METHOD

CROSS-REFERENCE TO RELATED APPLICATIONS

The present application is a continuation application of pending U.S. patent application Ser. No. 17/471,279, filed on Sep. 10, 2021, which claims the priority benefit of U.S. Provisional Patent Application Ser. No. 63/144,075, filed Feb. 1, 2021, the disclosures of which are incorporated by reference herein in their entireties.

TECHNICAL FIELD

The present disclosure relates to personal security and, more particularly, to a device, system and method for gunshot detection.

BACKGROUND

Increasing awareness of the risks posed by attackers using firearms has prompted demand for and development of systems to detect gunshots reliably under a variety of conditions.

The social and personal cost of missing alerts for gunshots and issuing false alerts for non-gunshots are quite high so great effort is warranted in improving the reliability of discrimination. Past gunshot detection systems are almost exclusively based on electronic and computer technology and oftentimes do not distinguish between indoor and outdoor environments. Because there is great variability in the physical phenomena being monitored and many physical configurations of monitored spaces, simply making the detection system more precise in any specific measurement does not in practice result in improvement. For similar reasons, there is no practical means for users to tune simple detectors to each particular physical space and firearm model.

Reliable detection of gunshots requires accommodation of features and effects associated with different environments, including indoor and outdoor environments. Further, past systems have problems with reliable rejection of events that have similar characteristics to gunshots but are not gunshots, such as slamming doors, falling books and other percussive acoustic impulse generators.

SUMMARY

The present disclosure addresses past challenges as described above and provides a versatile and reliable gunshot detection system, device and method for multiple environments, including indoor detection.

According to various embodiments as disclosed herein, several characteristic physical events associated with the operation of a firearm are monitored, including acoustic, infrared, visible light, and chemical and particle emissions. Embodiments of the present disclosure examines these events in various ways using physical and electronic sensors in reliably distinguishing between firearm and non-firearm sources. According to embodiments of the present disclosure, the physical event of the suspected firearm operation can be detected with an electronic sensor such as an acoustic detector and the captured data can be analyzed from multiple reference points in as close to real time as possible to minimize delays in reporting. Embodiments of the present disclosure further use multi-factor confirmation to improve the reliability of discrimination. Improvements in detection methods as described herein can minimize the effects of real-world variations and signal noise during the detection processes.

In various embodiments, a detected event is analyzed using a selected technique as the primary detection mechanism and using one or more different techniques as confirmations of the nature of the event. The primary mechanism is generally selected for being the most individually reliable. This choice of primary detection means can be fixed in the present system and device, determined during installation, or automatically determined during operation, for example. An example of automatic determination is the scaling of likelihood result of each method onto a common numerical comparison scale, then choosing the most likely (e.g., highest numerical value) as the primary detection approach. The confirmations can be applied where all must be asserted, as a majority voting scheme, with a weighted voting scheme, or in other ways to enhance both detection and rejection reliability.

DETAILED DESCRIPTION OF EMBODIMENTS

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

Example embodiments such as disclosed herein can incorporate a host, local device and/or controller having a processor and an associated memory storing instructions that, when executed by the processor, cause the processor to perform operations as described herein. It will be appreciated that reference to "a", "an" or other indefinite article in the present disclosure encompasses one or more than one of the described element. Thus, for example, reference to a processor encompasses one or more processors, reference to a memory encompasses one or more memories, reference to an acoustic sensor encompasses one or more acoustic sensors and so forth.

Figure 1:
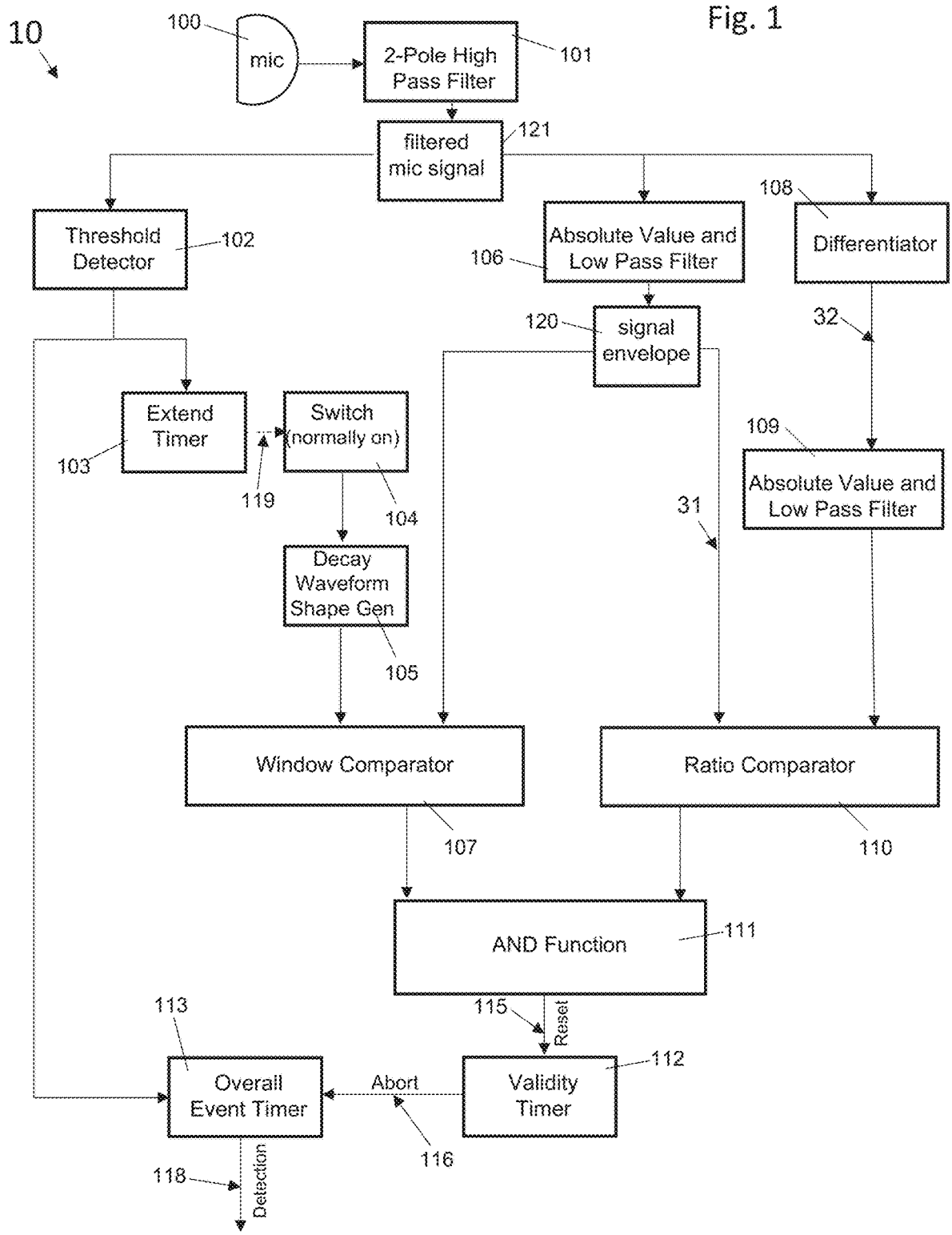
FIG. 1 is a flow diagram illustrating gunshot detection according to embodiments of the present disclosure.

In the diagram 10 shown in FIG. 1, three channels of analysis are involved for assessing whether a detected event is a gunshot. It will be appreciated that one or more microphones can be placed in an environment wherein a gunshot event may potentially occur. As shown in FIG. 1, the acoustic result of the environment including a suspected gunshot event is captured by a microphone 100 and converted to electrical signal form. The microphone may be implemented as a Micro-Electro-Mechanical Systems (MEMS) design, for example. In other embodiments, the microphone may be a capacitor type, dynamic type, piezoelectric type, or other technology. The microphone may be a single element or may include multiple elements. The microphone may convert sound into an analog electrical signal or directly into a digital data stream.

In various embodiments as shown in FIG. 1, the sound signal received from the microphone 100 can first be passed through a high pass filter 101 to eliminate any direct current (DC) offsets and low frequency components that may interfere with the later extraction of useful information. In at least one embodiment, the high pass filter 101 is 2-poles and has a −3 dB point of 100 Hz. Embodiments can have a different cutoff frequency and/or number of poles and the entire system can operate entirely in the analog or entirely in the digital domain, or in any hybrid combination of these. The filtered microphone signal is identified as at 121 and is made available for further processing.

As shown in the left side of diagram 10, a threshold detector or comparator 102 and timer 103 are employed as an approach to detection timing and control. This process can commence any time the filtered microphone signal 121 exceeds a preset threshold as determined by threshold detector 102. According to various embodiments, this threshold can be set at least somewhat below the acoustic overload point (AOP) of the microphone 100 so that detection is possible even with events that physically overload the microphone 100. Crossing this threshold starts the extend timer 103 and an overall event timer 113. In at least one embodiment, the signal is required to exceed the equivalent of 125 dB sound pressure level (SPL) for the detection process to begin. In such embodiments, the extend timer 103 is set to ten milliseconds and the overall event timer 113 is set to fifty milliseconds. It will be appreciated that other embodiments may use different timing intervals and different overall detection thresholds. Regardless, during the overall event timer interval, the other elements of detection take place as shown in FIG. 1.

As further shown in diagram 10 of FIG. 1, the resulting filtered mic signal 121 is also connected to an absolute value function and low pass filter function 106. These functions extract an envelope signal 120 closely equivalent to amplitude envelope of the signal 121. In one embodiment, the low pass filter has 2-poles and a cutoff frequency of 50 Hz. In other embodiments, other numbers of poles and other cutoff frequencies may be used.

Figure 2:
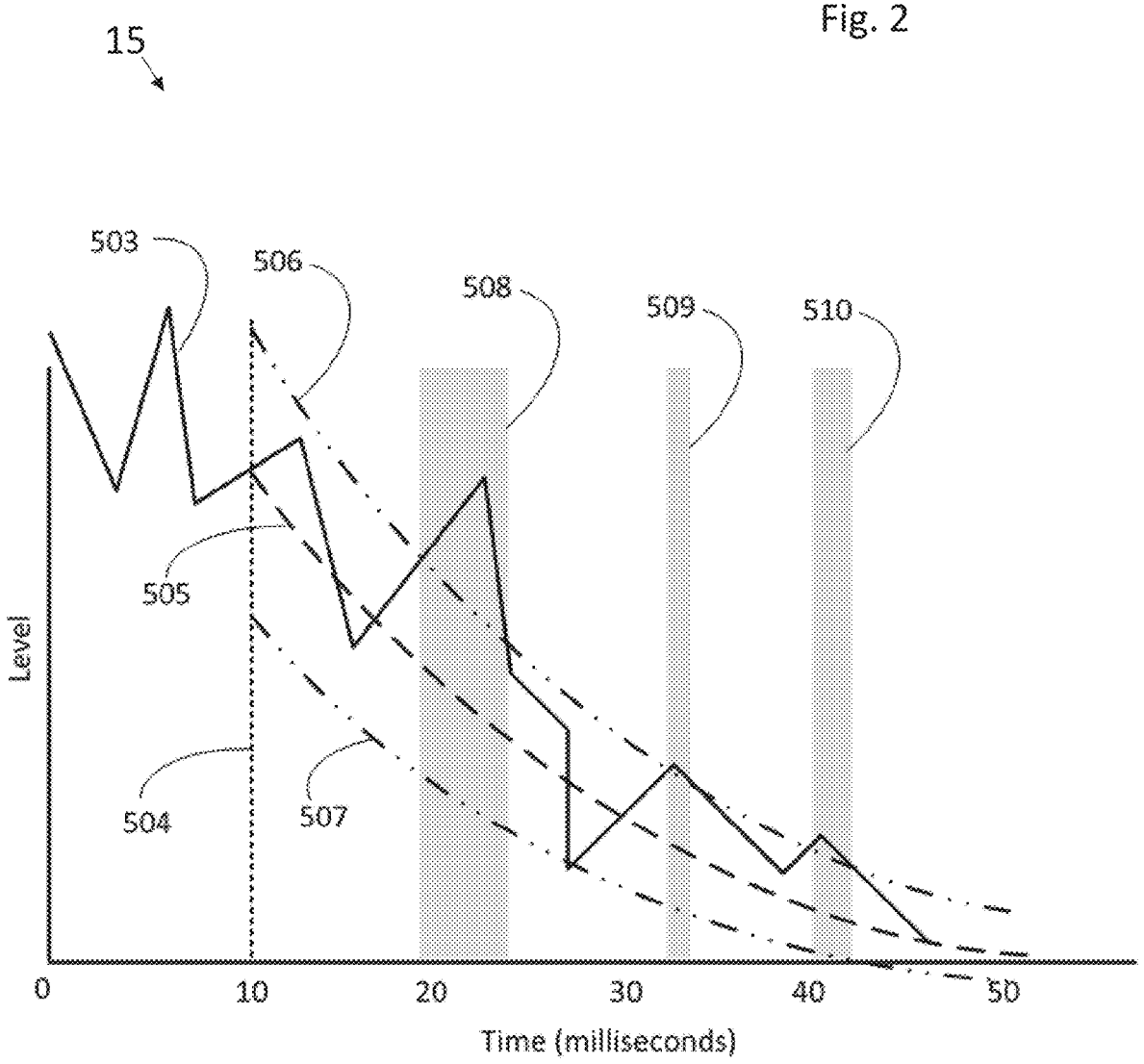
FIG. 2 is a graph depicting decay waveform according to embodiments of the present disclosure.

Impulse Decay Rate Testing Embodiments as described herein can discriminate gunshots from other impulses or other sound event through evaluation of the decay time of the signal envelope 120 in comparison to a generated standard as at 105 such as through employment of a window comparator 107. In such embodiments, the signal envelope 120 is conducted through a normally closed switch 104 to a decay waveform shape generator 105. While the switch is closed, the value of the decay waveform shape generator is clamped to that of the signal envelope 120. The extend timer 103 serves to delay the start of the decay waveform generation 105 via communication link 119 until the portion of the signal envelope 120 that may be distorted by transient conditions such as microphone overload has passed. With additional reference to graph 15 in FIG. 2, when the extend timer 103 expires, the switch 104 opens, and the decay waveform shape generator 105 begins to create the standard decay waveform 505 starting from the amplitude of the signal envelope 120 at the time 504 that the switch 104 opened. In at least one embodiment, the extend timer 103 has a duration of ten milliseconds and the decay waveform shape generator 105 has a time constant of twenty milliseconds. Other embodiment may utilize other durations for the extend timer 103 and other time constants for the decay waveform 505.

Decay Rate Comparison

The signal envelope 120 and the generated decay waveform 505 are compared in the window comparator 107. The window comparator establishes dynamic upper 506 and lower 507 limits based on the decay waveform. As long as the signal envelope, represented as 503 in FIG. 2, remains between these limits, the output of the window comparator is asserted (true). Any time the signal envelope 503 varies beyond the established upper or lower limits, such as shown at 508, 509 and 510 in FIG. 2, the output of the window comparator becomes de-asserted (false). In the embodiment shown in FIG. 2, the upper limit 506 is established as fifty percent greater than the decay waveform 505 and the lower limit 507 is established as fifty percent lower than the decay waveform 505. Other embodiments can have other fixed percentages, variable percentages, fixed difference values or variable difference values. In various embodiments according to the present disclosure, upon the signal amplitude measurement of the signal envelope (i.e., the original channel signal amplitude measurement) remaining within the upper limit and the lower limit for the decay waveform during the decay time, the process generates a decay signal. Such a decay signal can be considered as a component of a positive gunshot detection according to various embodiments of the present disclosure.

Spectrum Evaluation

Referring back to FIG. 1, the frequency spectrum of the filtered mic signal 121 is evaluated by testing for the lack of tonality that is characteristic of short impulse events like gunshots. Other event sources typically produce acoustic energy with some concentrated tonality. Lack of such tonality is taken as a confirmation that the impulse is likely a gunshot. In at least one embodiment, the signal 121 from the high pass filter 101 is passed through a differentiator 108 and both the original and differentiated signals are passed through respective absolute value functions and low pass filter functions, shown respectively at 106 and 109 in FIG. 1, to provide a voltage amplitude measurement of each channel, filtered to remove much of the ripple. It will be appreciated that the passing of the filtered mic signal 121 through absolute value and low pass filter 106 is along an original channel 31 and the passing of the filtered mic signal 121 through absolute value and low pass filter 106 is along a differentiated channel 32. In this embodiment, both low pass filters 106, 109 have 2-poles and 50 Hz cutoff frequencies. In other embodiments, other filter configuration and cutoff frequencies may be employed.

Figure 3:
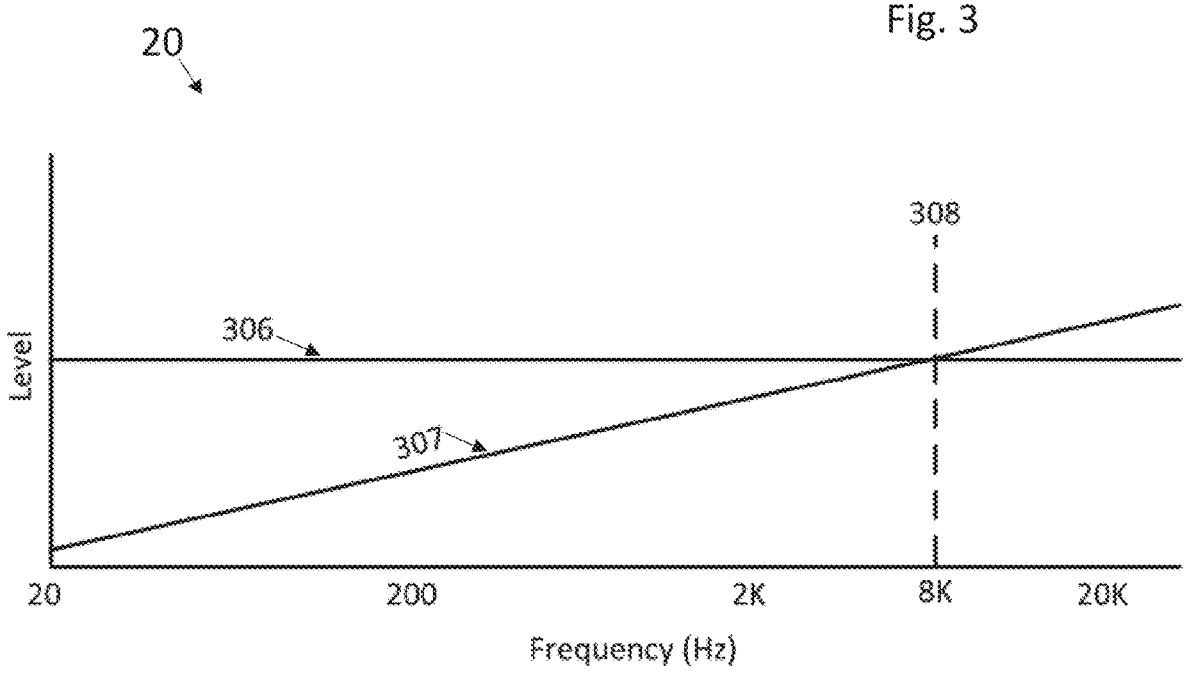
FIG. 3 is a graph depicting signal frequency responses for a potential gunshot detection according to embodiments of the present disclosure.

Referring to chart 20 in FIG. 3, the original channel 31 has a flat frequency response as indicated at 306 while the differentiated channel 32 has a tilted (e.g., 6 db per octave) frequency response as indicated at 307. In at least one embodiment, the filters are implemented in a digital system with a 48K samples per second (sps) sample rate. This results in the differentiated signal amplitude 307 crossing over the original signal amplitude 306 at 8 KHz as indicated at 308. The bulk of the energy in the signal from the high pass filter is below this 8 KHz crossover point.

In such embodiments as described and with reference to FIG. 1, a ratio comparator 110 is set so that the differentiated signal amplitude as determined after processing through differentiator 108 and low pass filter 109 must equal at least 0.5 times the original signal amplitude for the event to be considered a gunshot and the ratio comparator 110 output asserted as true. It will be appreciated that other embodiments may use analog or digital processing, different sample rates, and different fractional detection thresholds. In various embodiments, upon the differentiated channel signal amplitude measurement being at least a first fractional percentage of the original channel signal amplitude measurement, a signal indicating lack of tonality can be generated for use with an initial positive gunshot detection as described elsewhere herein. Such a signal indicating lack of tonality can be considered as a component of a positive gunshot detection according to various embodiments of the present disclosure.

In various embodiments according to the present disclosure, a combination of the decay evaluation output from window comparator 107 and the spectrum evaluation output from ratio comparator 110 is used to make the final determination of whether or not the event is a gunshot. As illustrated in FIG. 1, the results of both of these evaluations are combined in an AND function 111 such that both evaluations must be asserted as true for the output 115 of the AND function to be asserted as true. As described above, the outputs of the decay evaluation may temporarily become false during the overall period of evaluation (as illustrated at 508, 509, 510 in FIG. 2) or the Spectrum Evaluation may temporarily become false during the overall period of evaluation, resulting in short periods of false output 115 from the AND function 111. In order that short periods of false output 115 do not result in failed gunshot detection, this signal 115 is used to reset a validity timer 112. The validity timer 112 allows for some dropouts of the required conditions such as caused by echoes, for example. It is held reset while both conditions from window comparator 107 and ratio comparator 110 are present and starts if/when the required conditions become missing. If this timer 112 completes, it aborts overall event timer 113 as at 116, preventing a gunshot detection. This completion indicates that an invalidity in the simultaneous truth of the two required conditions was longer than the duration of this timer.

As long as the validity timer 112 is reset in less than its established time interval, the validity timer output 116 will not be asserted, and the overall event timer 113 will not be aborted. In various embodiments, the overall event timer 113 starts from first peak detected and has a start input and an abort input. If the overall event timer completes, it is a gunshot. If the overall event timer 113 runs to completion, the event is deemed a gunshot and the overall event timer output 118 is asserted. If the overall event timer 113 is aborted by either of the evaluations as determined by AND component 111 or a combination of the evaluations failing for more than the duration of the validity timer 112, the overall event timer output is not asserted and the event is deemed a non-gunshot. In one embodiment, the validity timer 112 is set for ten milliseconds and the overall event timer 113 is set to fifty milliseconds. In other embodiments, different time settings can be employed.

It will be appreciated that, although the above-described operation is based on two required conditions in addition to the crossing of the threshold detector 102, other embodiments could include further detected conditions combined in a larger AND gate than AND gate 111, for example.

In various embodiments, a fully qualified gunshot detection can trigger an alert to proper personnel or authorities. In various embodiments, the detection output 118 is directed to a network interface that is implemented by the digital processing. This interface causes the detection output to be transmitted over any available network such as Wi-Fi, Ethernet, Bluetooth, Zigbee (Z-Wave) or other protocol over a local network or the Internet for the purpose of alerting and/or logging the alerts. In other embodiments, locally wired alerting mechanisms such as sirens or strobe lights can also be utilized. In still other embodiments, partially qualified events may trigger separate types of communications or outputs. In such a case, the outputs of the ratio comparator 110 and/or the window comparator 107 may be separately timed for validity and may generate a separate event indicating a lower likelihood of the event being a gunshot. Thus, an output of the ratio comparator 110 alone can independently trigger a gunshot detection and an output of the window comparator 107 alone can independently trigger a gunshot detection according to embodiments of the present disclosure.

Figure 6:
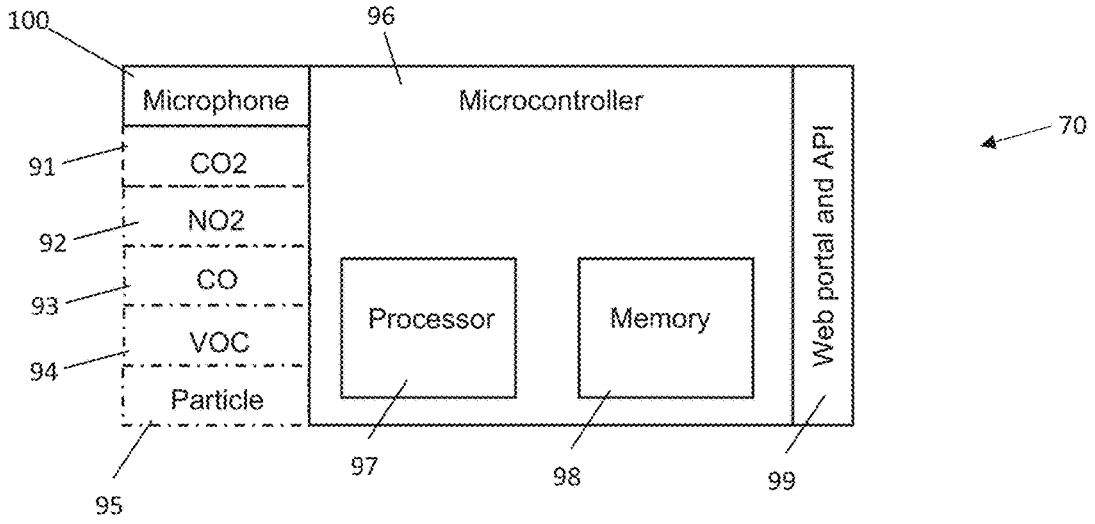
FIG. 6 is a schematic diagram illustrating one embodiment of computing elements according to embodiments of the present disclosure.

FIG. 6 shows an exemplary schematic diagram representation of an embodiment of a sensor device 70 for use in accordance with the present disclosure. As shown in this embodiment, the device 70 includes and/or is in communication with a microphone 100. The device 70 may optionally incorporate and/or be in communication with one or more air quality sensors such as one or more gas sensors 91, 92, 93, 94 and/or a particle sensor 95, all of which are in dashed lines to indicate optional inclusion. It will be appreciated that other sensors for other purposes such as an environmental sensor and other gas sensors beyond those shown can be included in various embodiments of the disclosure.

It will be appreciated that the digital output of one or more of the sensors can be communicated to a microcontroller 96 via I2C protocol. I2C is a serial protocol for two-wire interface to connect low-speed devices like microcontrollers, EEPROMs, A/D and D/A converters, I/O interfaces and other similar peripherals in embedded systems. The analog signal from microphone 100 can be converted using an AD converter (not shown) which communicates with the microcontroller 96. The microcontroller can further include a memory 98 storing programming for execution by processor 97, and an application programming interface (API) and web portal 99 to facilitate communications with external systems and programs.

Figure 7:
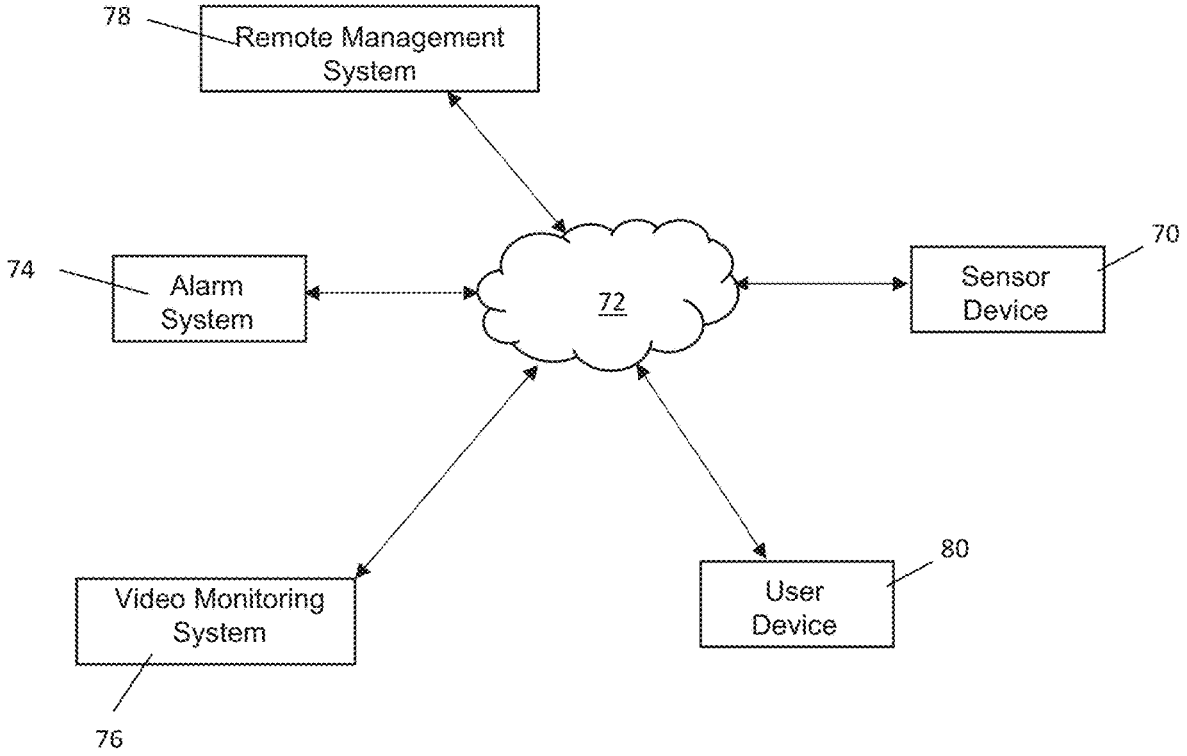
FIG. 7 is a schematic diagram illustrating elements of a system according to the present disclosure.

As shown in FIG. 7, the sensor device 70 in accordance with embodiments of the present disclosure is operable to connect to a network 72 to provide real-time analysis, inform other systems such as an alarm system 74, video monitoring system 76 and remote management system 78, and provide other functions as described herein. A communications device 80 such as a desktop computer, laptop, notebook, mobile device, personal communications device such as a smartphone or other computing device can communicate via network 72 to various systems, including with remote system 78 to configure and/or monitor the sensor device 70. Such communications can include establishing thresholds and/or profiles to be used as preset measurements for a variety of detections, comparisons and calculations as described herein. In various embodiments, the microcontroller 96 for the sensor device 70 runs an operating system such as Debian Linux, Windows, Android, iOS, an RTOS or other operating system together with dedicated applications. The device 80 is provided with sufficient physical input/output (I/O), a memory and processing power for real-time analysis and the other functions, wherein the functions are executed by a processor executing programming instructions stored in the memory. As described elsewhere herein, in various embodiments, the sensor device 70 includes a PoE power interface and regulator delivering 5 VDC for system operation. This can be further sub-regulated to 3.3 VDC and 1.8 VDC for certain components.

The video monitoring system 76 can include one or more video cameras adapted to record video of a surveilled premises, such as where one or more acoustic sensors (e.g., microphones) 100 are installed. The video camera(s) can transmit recorded video and optionally audio to a system such as external management system 78 in accordance with communication methods as will be understood to those of ordinary skill. The sensor device 70 can receive monitoring data from one or more of the group of sensors, and can also generate a profile of one or more detected substances, wherein the profile specifies relative concentrations of gases and/or particles, such as in numeric form, for example. When the detected substance is gunfire or burnt powder, for example, the profile may provide details of particles, volatile organic compounds and carbon dioxide. When the sensor device determines that at least a portion of the received monitoring data is indicative of an exceeded threshold and/or when the received monitoring data matches that of a generated profile, a communication such as a detected event communication can be transmitted to the video monitoring system to initiate video recording of the premises. The detected event communication can also be a signal indicating lack of tonality and/or a decay signal, for example, which according to various embodiments can be generated during an overall event time period.

In various embodiments, the one or more gas sensors can include, for example, a carbon dioxide (CO2) sensor 91, a nitrogen dioxide (NO2) sensor 92, a carbon monoxide (CO) sensor 93 and/or a volatile organic compound (VOC) sensor 94. Further, thresholds can be established above ambient environment measurements for one or more of a particle sensor 95, CO2 sensor 91, NO2 sensor 92, CO sensor 93 and VOC sensor 94, whereupon a suitable measured increase in measurements from one or more such sensors after an initially detected gunshot provides a confirmation.

It will be appreciated that one or more of the gas sensors and/or the particle detection sensor is helpful in providing confirmation of an initial gunshot detection. For instance, one or more such sensors can be combined into an integrated device, with our without acoustic sensor(s), secured in a specific location being monitored and baseline ambient measurements can be taken for each device. A computing device and/or electronic control system in communication with the sensor(s) can detect measurements from the sensor (s) over time, and can be directed via suitable programming instructions to establish a profile for gunshot detection confirmation, wherein the profile establishes one or more threshold measurements from the one or more sensors. In various embodiments, if the one or more thresholds is exceeded within a defined time frame after a sensed gunshot detection according to the various methods of the present disclosure, a gunshot detection confirmation can be issued by the computing device and/or electronic control system. In this way, effects such as a gunshot muzzle "cloud" of residue emitted from a gun barrel can be detected.

If a single device is installed in a room, a-priori knowledge of the size of the room can be provided and established as conditions to consider by the embodiments of the present disclosure. A worst-case time delay could be calculated based upon the room size and airflow in the room, for example. If the air quality were to change above a threshold during that period, then the potential gunshot is now verified to be a true gunshot event. In a room with multiple installed sensor devices, the time of the gunshot detection can be recorded for each device. Knowing the location of each device within the room, the size of the room, the approximate air flow in the room and then triangulating the location of the gunshot, the distance to each installed device can be calculated. Based upon this calculated distance, the time delay from the perceived gunshot event detection can be calculated. In either case, the air flow portion will only be an approximation and an additional delta time can be added to the calculated time delay to allow for variances. In various embodiments, an installed sensor can receive a measurement from the air quality sensor and a processor in communication with the sensor can determine that the measurement from the air quality sensor exceeds a threshold for gunshot detection confirmation. Such a determination can be part of confirming one or more other detections as part of confirmation a fully qualified gunshot detection, for example.

In various embodiments, a distance from the microphone is calculated from the presumed gunshot, and the system and device as disclosed herein can calculate a propagation delay of air quality and sense an increase of either particles, CO2, or NO2, or any combination thereof, after a delay with some programmable delay for air flow, that the gunshot detected is indeed a gunshot due to the change of air quality. In various embodiments, the distance of the gunshot from the microphone can be calculated by identifying the delay between the gun flash and the gunshot audio impulse. It may also be detected from the gunshot impulse and reverberations. It will be appreciated that, upon gunshot confirmation, Bluetooth and/or cell phone technologies can be employed to identify the presence of electronic devices in the area as a signature of an individual who could have possibly pulled the trigger that initiated the gunshot detection.

Figure 4:
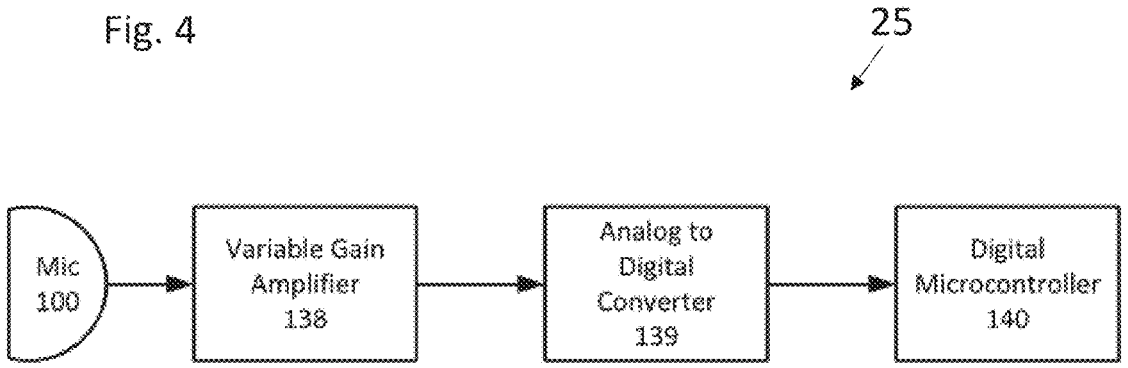
FIG. 4 is a flow diagram illustrating as aspect of gunshot detection according to embodiments of the present disclosure.

It will be appreciated that the functions and processes described in the above embodiments may be implemented in analog circuitry, digital circuitry, computer processing, or any combination of the these. In the case of digital circuitry and/or computer processing, it is possible to have the event capture implemented as an analog design and the remainder of the embodiment operate in the digital domain. An exemplary embodiment is shown in diagram 25 of FIG. 4, where analog microphone 100 is followed by a variable gain amplifier 138 before the signal is directed to an analog to digital converter 139 and then to the digital microcontroller, digital signal processor, gate array or other suitable digital processing environment 140. In this embodiment, the amplifier gain can be adjusted/set so that the maximum possible signal from the microphone (acoustic overload point (AOP)) is within the linear range of operation of the analog to digital converter 139 so that the digital processing 140 starts with a faithful copy of the microphone output.

It will be appreciated that the multiple confirmations described herein greatly improve the reliability of gunshot detection and rejection of false alerts. Further confirmation of presumed gunshot detection can employ additional sensors in hardware form according to various embodiments of the present disclosure. For example, when more than one detection unit is installed in a single space, the units can cooperate by providing additional confirmation signals to each other using the network interface. This message to neighbors can be developed by the ratio comparator 110 and the window comparator 107 and may not be fully qualified but is still sufficient to be considered a confirmation. The receiving network interface routes this message back into its associated gunshot validation logic which can include AND gate 111, validity timer 112 and overall event timer 113, whereupon it is considered a confirmation by the logic.

Figure 5:
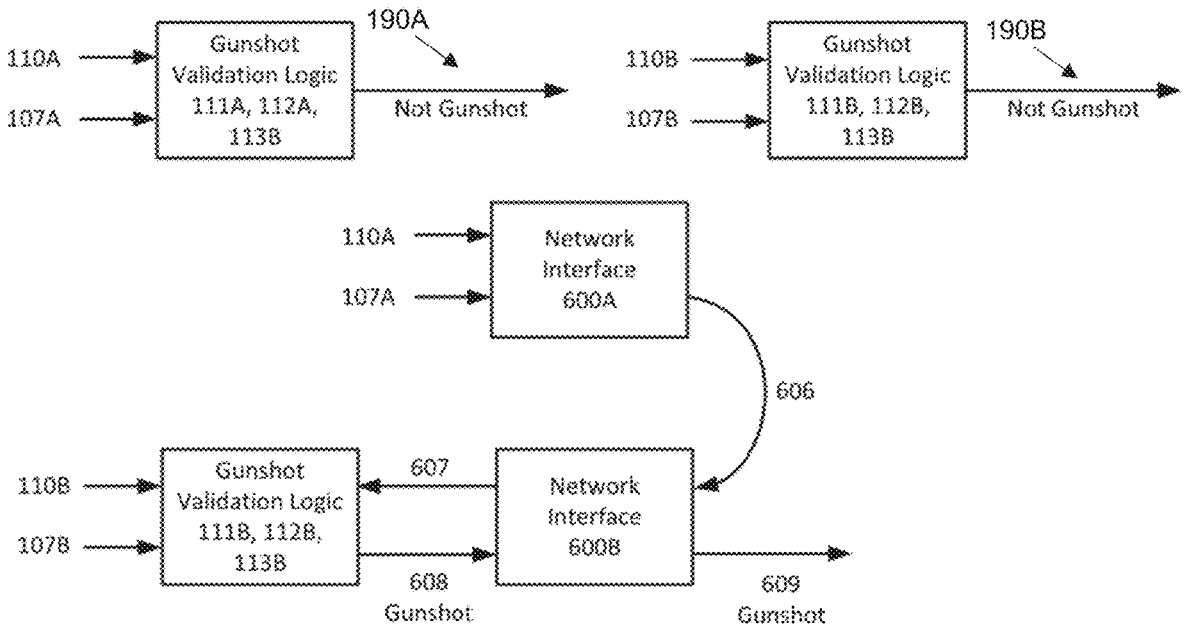
FIG. 5 is a schematic diagram illustrating peer-to-peer analysis according to embodiments of the present disclosure.

FIG. 5 illustrates an embodiment of the above-described process. As shown in FIG. 5, primary A and secondary B sensor units (not shown) are presumed installed and operating in a common space. Each sensor unit A and B can include a respective acoustic sensor and processing component and may optionally include additional sensor components as described elsewhere herein. A gunshot occurs in this common space but somewhat distant from both units. Confirmation signals (110A, 107A) and (110B, 107B) are sent to the respective gunshot validation logic (111A, 112A, 113A and 111B, 112B, 113B). These are insufficient to cause a fully validated alert to be generated as indicated at 190A and 190B, but they are sufficient to generate a less qualified confirmation signal to be received by network interface 600A and transmitted to network interface 600B as indicated at 606. These partial confirmation signals 606 from sensor A are communicated to neighboring units as at 607 where they are now considered together 606 with the other signals 110B, 107B associated with sensor B. This additional confirmation causes the gunshot validation logic (111B, 112B, 113B) associated with sensor B to generate a fully qualified alert as at 608 to network interface 600B which is then transmitted as a network alert as indicated at 609.

It will be appreciated that different sensor units or different measurements can be determined to be the main mechanism by which reliable gunshot detection is assessed, and the main mechanism can vary depending upon location, environment, type of sensor and other factors. This choice of main detection means can be fixed in the present system and device, determined during installation, or automatically determined during operation, for example. As an example with reference to FIG. 5, the system can automatically determine a likelihood of confirmation value for sensor B based on the sound signal received by sensor B, and can further determine a likelihood of confirmation value for sensor A based on the sound signal received by sensor A. If the likelihood of confirmation value for sensor B is higher than that for sensor A, then sensor B can automatically be determined as the main detection means for a given environment where sensors A and B are installed. It will be appreciated that the main detection means need not be associated with a particular sensor but can also be associated with different channels of analysis, such as where the ratio comparator analysis performed by ratio comparator 110 is determined to be the main detection mechanism or where the window comparator analysis performed by window comparator 107 is determined to be the main detection mechanism, for example.

The symmetry of this design allows this process to work similarly between any number of associated units. Other embodiments can pass different signals between peers. In addition to allowing completely validated alerts to be communicated between peers, embodiments of the present disclosure can communicate partially validated and uncombined signals between units to allow more accurate and more flexible final validation.

It will thus be appreciated that the presently disclosed embodiments provide a technical solution for evaluating characteristic physical events associated with the operation of a firearm such as one or more of the acoustic, infrared, visible light, and chemical and particle emission events as part of assessing whether a gunshot event is detected in a given environment.

Unless otherwise stated, devices or components of the present disclosure that are in communication with each other do not need to be in continuous communication with each other. Further, devices or components in communication with other devices or components can communicate directly or indirectly through one or more intermediate devices, components or other intermediaries. Further, descriptions of embodiments of the present disclosure herein wherein several devices and/or components are described as being in communication with one another does not imply that all such components are required, or that each of the disclosed components must communicate with every other component. In addition, while algorithms, process steps and/or method steps may be described in a sequential order, such approaches can be configured to work in different orders. In other words, any ordering of steps described herein does not, standing alone, dictate that the steps be performed in that order. The steps associated with methods and/or processes as described herein can be performed in any order practical. Additionally, some steps can be performed simultaneously or substantially simultaneously despite being described or implied as occurring non-simultaneously.

It will be appreciated that algorithms, method steps and process steps described herein can be implemented by appropriately programmed computers and computing devices, for example. In this regard, a processor (e.g., a microprocessor or controller device) receives instructions from a memory or like storage device that contains and/or stores the instructions, and the processor executes those instructions, thereby performing a process defined by those instructions. Furthermore, aspects of the present disclosure may take the form of a computer program product embodied in one or more computer readable media having computer readable program code embodied thereon.

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium include the following: a portable computer diskette, a hard disk, a random-access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, as exemplified above. The program code may execute entirely on a user's computer, partly on a user's computer, as a stand-alone software package, partly on a user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Where databases are described or implied in the present disclosure, it will be appreciated that alternative database structures to those described, as well as other memory structures besides databases may be readily employed. Any drawing figure representations and accompanying descriptions of any exemplary databases presented herein are illustrative and not restrictive arrangements for stored representations of data. Further, any exemplary entries of tables and parameter data represent example information only, and, despite any depiction of the databases as tables, other formats (including relational databases, object-based models and/or distributed databases) can be used to store, process and otherwise manipulate the data types described herein. Electronic storage can be local or remote storage, as will be understood to those skilled in the art. Appropriate encryption and other security methodologies can also be employed by the system of the present disclosure, as will be understood to one of ordinary skill in the art.

The above-described embodiments of the present disclosure may be implemented in accordance with or in conjunction with one or more of a variety of different types of systems, such as, but not limited to, those described below.

The present disclosure contemplates a variety of different systems each having one or more of a plurality of different features, attributes, or characteristics. A "system" as used herein refers to various configurations of: one or more central controllers or microcontrollers, and/or one or more subsystems or additional devices alone or in communication with one or more central controllers or microcontrollers, wherein the one or more subsystems or additional devices can include a sensor or other computing device as described herein, for example.

In certain embodiments in which the system includes a server, central controller, or microcontroller, the server, central controller, or microcontroller is any suitable computing device (such as a server) that includes at least one processor and at least one memory device or data storage device. The processor of the additional device, server, central controller, or microcontroller is configured to transmit and receive data or signals representing events, messages, commands, or any other suitable information between the server, central controller, or remote host and the additional device.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented as entirely hardware, entirely software (including firmware, resident software, micro-code, etc.) or combining software and hardware implementations that may all generally be referred to herein as a "circuit," "module," "component," or "system." Furthermore, aspects of the present disclosure may take the form of a computer program product embodied in one or more computer readable media having computer readable program code embodied thereon.

The invention claimed is:

1. A method for facilitating a gunshot detection, comprising:

receiving a sound signal via an acoustic sensor;

filtering the sound signal through a high pass filter to provide a filtered signal;

filtering the filtered signal through a first low pass filter to provide an original channel signal envelope comprising an original channel signal amplitude measurement;

filtering the filtered signal through a differentiator and a second low pass filter to provide a differentiated signal comprising a differentiated signal amplitude measurement;

comparing the original channel signal amplitude measurement with the differentiated signal amplitude measurement;

upon the differentiated signal amplitude measurement being at least a first fractional portion of the original channel signal amplitude measurement, generating a first partially qualified positive gunshot detection signal;

determining that the filtered signal exceeds a preset, threshold sound level at a given time;

generating a secondary partially qualified positive gunshot detection signal; and based on the first partially qualified positive gunshot detection signal and the secondary partially qualified positive gunshot detection signal, generating a fully qualified positive gunshot detection signal.

2. The method of claim 1, further comprising:

generating, based on the filtered signal, a signal indicating lack of tonality for an initial positive gunshot detection; and determining whether the signal indicating lack of tonality is generated during an overall event time period initiated at the given time.

3. The method of claim 2, further comprising:

upon the signal indicating lack of tonality and the decay signal component occurring within a pre-established overall event time period, generating a detected event communication.

4. The method of claim 1, wherein the original channel signal envelope further comprises a decay time and a decay waveform, wherein the decay time of the original channel signal envelope is measured beginning at an end of the extend time period, and wherein the method further comprises:

establishing an upper limit and a lower limit for the decay waveform;

upon the original channel signal amplitude measurement remaining within the upper limit and the lower limit for the decay waveform during the decay time, generating a decay signal component for an initial positive gunshot detection, wherein generating the decay signal component comprises generating a true output;

upon the original channel signal amplitude measurement remaining beyond the upper limit or the lower limit for the decay waveform during the decay time, generating a false output; and establishing a validity timer comprising a validity duration, wherein the validity duration is reset upon receiving an input indicating the true output and the signal indicating lack of tonality.

5. The method of claim 4, wherein the validity timer issues an abort signal indicating a negative gunshot detection if the validity duration expires during the overall event time period.

6. A device for facilitating a gunshot detection, comprising:

an acoustic sensor; and a processor, and a memory storing instructions, that when executed by the processor, cause the processor to:

receive a sound signal via the acoustic sensor;

filter the sound signal through a high pass filter to provide a filtered signal;

filter the filtered signal through a first low pass filter to provide an original channel signal envelope comprising an original channel signal amplitude measurement;

filter the filtered signal through a differentiator and a second low pass filter to provide a differentiated signal comprising a differentiated signal amplitude measurement;

compare the original channel signal amplitude measurement with the differentiated signal amplitude measurement;

upon the differentiated signal amplitude measurement being at least a first fractional portion of the original channel signal amplitude measurement, generate a first partially qualified positive gunshot detection signal;

determine that the filtered signal exceeds a preset threshold sound level at a given time;

generate a secondary partially qualified positive gunshot detection signal; and based on the first partially qualified positive gunshot detection signal and the secondary partially qualified positive gunshot detection signal, generate a fully qualified positive gunshot detection signal.

7. The device of claim 6, wherein the instructions further cause the processor to:

generate, based on the filtered signal, a signal indicating lack of tonality for an initial positive gunshot detection; and determine whether the signal indicating lack of tonality is generated during the overall event time period.

8. The device of claim 7, wherein the instructions further cause the processor to:

upon the signal indicating lack of tonality and the decay signal component occurring within a pre-established overall event time period, generate a detected event communication.

9. The device of claim 6, wherein the original channel signal envelope further comprises a decay time and a decay waveform, wherein the decay time of the original channel signal envelope is measured beginning at an end of the extend time period, and wherein the instructions further cause the processor to:

establish an upper limit and a lower limit for the decay waveform;

upon the original channel signal amplitude measurement remaining within the upper limit and the lower limit for the decay waveform during the decay time, generate a decay signal component for an initial positive gunshot detection, wherein generating the decay signal component comprises generating a true output;

upon the original channel signal amplitude measurement remaining beyond the upper limit or the lower limit for the decay waveform during the decay time, generate a false output; and establish a validity timer comprising a validity duration, wherein the validity duration is reset upon receiving an input indicating the true output and the signal indicating lack of tonality.

10. The device of claim 9, wherein the validity timer issues an abort signal indicating a negative gunshot detection if the validity duration expires during the overall event time period.

11. A method for facilitating valid gunshot detections, comprising:

receiving a sound signal by an acoustic sensor;

filtering the sound signal through a high pass filter to provide a filtered signal;

filtering the filtered signal through a first low pass filter to provide a signal envelope comprising an original channel signal amplitude measurement;

filtering the filtered signal through a differentiator and a second low pass filter to provide a differentiated signal comprising a differentiated signal amplitude measurement;

comparing the original channel signal amplitude measurement with the differentiated signal amplitude measurement; and upon the differentiated signal amplitude measurement being at least a first fractional portion of the original channel signal amplitude measurement, generating a detected event communication.

12. The method of claim 11, wherein the signal envelope further comprises a decay time and a decay waveform, and wherein the method further comprises:

based upon the differentiated channel signal amplitude measurement, generating a signal indicating lack of tonality for an initial positive gunshot detection;

upon the original channel signal amplitude measurement remaining within a boundary for the decay waveform during at least a portion of the decay time, generating a decay signal component for an initial positive gunshot detection; and prior to generating the detected event communication, establishing a validity timer comprising a validity duration, wherein the validity duration is reset at least once during an overall event time period based upon the generation of the signal indicating lack of tonality and the decay signal component.

13. A system, comprising:

a primary sensor unit in communication with a network, wherein the primary sensor unit comprises a primary acoustic sensor and a primary processing component; and a secondary sensor unit in communication with the network, wherein the secondary sensor unit comprises a secondary acoustic sensor and a secondary processing component;

wherein the primary processing component comprises a primary processor, and a primary memory storing instructions, that when executed by the primary processor, cause the primary processor to:

receive a sound signal via the primary acoustic sensor;

filter the sound signal through a primary sensor unit high pass filter to provide a primary sensor unit filtered signal;

filter the primary sensor unit filtered signal through a primary sensor unit first low pass filter to provide a primary sensor unit original channel signal comprising a primary sensor unit original channel signal amplitude measurement;

filter the primary sensor unit filtered signal through a primary sensor unit differentiator and a primary sensor unit second low pass filter to provide a primary sensor unit differentiated signal comprising a primary sensor unit differentiated signal amplitude measurement;

compare the primary sensor unit original channel signal amplitude measurement with the primary sensor unit differentiated signal amplitude measurement; and upon the primary sensor unit differentiated signal amplitude measurement being at least a first fractional portion of the primary sensor unit original channel signal amplitude measurement generate a first partially qualified positive gunshot detection signal;

wherein the secondary processing component comprises a secondary processor, and a secondary memory storing instructions, that when executed by the secondary processor, cause the secondary processor to:

receive the sound signal via the secondary acoustic sensor;

determine that the signal exceeds a preset threshold sound level at a given time;

generate a secondary partially qualified positive gunshot detection signal;

receive, via the network, the first partially qualified positive gunshot detection signal; and generate a fully qualified positive gunshot detection signal.

14. The system of claim 13, wherein the instructions stored in the secondary memory, when executed by the secondary processor, further cause the secondary processor to convey to the primary sensor unit via the network a beginning time when the sound signal is received by the secondary acoustic sensor, and wherein the instructions stored in the primary memory, when executed by the primary processor, further cause the primary processor to convey to the secondary sensor unit via the network a first time when the sound signal is received by the primary acoustic sensor, wherein the first time is later than the beginning time.

15. The system of claim 13, further comprising an air quality sensor in communication with the network, wherein the secondary sensor unit receives a measurement from the air quality sensor and wherein the instructions stored in the secondary memory, when executed by the secondary processor, determine that the measurement from the air quality sensor exceeds a threshold for gunshot detection confirmation prior to generating a fully qualified positive gunshot detection signal.

16. The method of claim 1, wherein the acoustic sensor is located in an environment and wherein the preset threshold sound level is unrelated to a condition in the environment.

17. The device of claim 6, wherein the acoustic sensor is located in an environment and wherein the preset threshold sound level is unrelated to a condition in the environment.

* * * * *